US009199183B2

(12) United States Patent
Canobbio

(10) Patent No.: US 9,199,183 B2
(45) Date of Patent: Dec. 1, 2015

(54) DEVICE FOR LAUNCHING OBJECT AWAY FROM A USER

(71) Applicant: Dan Canobbio, Frisco, TX (US)

(72) Inventor: Dan Canobbio, Frisco, TX (US)

(73) Assignee: Dan Canobbio, Frisco, TX (US)

( * ) Notice: Subject to any disclaimer, the term of this patent is extended or adjusted under 35 U.S.C. 154(b) by 163 days.

(21) Appl. No.: 14/076,202

(22) Filed: Nov. 9, 2013

(65) Prior Publication Data

US 2014/0141691 A1 May 22, 2014

Related U.S. Application Data

(60) Provisional application No. 61/724,889, filed on Nov. 9, 2012.

(51) Int. Cl.
*A63B 49/00* (2015.01)
*A63H 37/00* (2006.01)

(52) U.S. Cl.
CPC ..... *A63H 37/005* (2013.01)

(58) Field of Classification Search
None
See application file for complete search history.

(56) References Cited

U.S. PATENT DOCUMENTS 5,334,079 A * 8/1994 Gentile et al. ..... 446/486
2014/0027324 A1* 1/2014 Kim et al. ..... 206/232

* cited by examiner

*Primary Examiner* — Sunit Pandya

(57) ABSTRACT

A device for launching an object away from a user comprising a popper placed on the floor for providing force for the object, a ramp positioned on said popper wherein the user applies pressure on a substantially planar peripheral portion of said popper by pressing plurality of legs through placement of foot on an elongated body of the ramp resulting in change of convex position of said substantially planar peripheral portion returns to a concave position of said substantially planar peripheral portion through the application of vertical force on said object base which further results in launching the object away from a user from said object base.

1 Claim, 5 Drawing Sheets

DEVICE FOR LAUNCHING OBJECT AWAY FROM A USER

BACKGROUND OF THE INVENTION

1. Field of the Invention

The present invention generally relates to a device for launching object away from a user and more particularly relates to a device for launching object away from a user using a popper and a ramp.

2. Description of Related Art

Children like to play with the toys which launch objects into the air and also children like to play in groups with toys that can be used to launch objects at each other. Such toys should be designed so that the children are not hurt by the projectile as may happen when launching an object with too much force.

US Patent Publication No. 2153957 discloses a popper invented by Jerome Davis in the year of 1938. Poppers are simple toys that jump upwardly into the air. The working part of the toy is a more or less hemispherical body consisting of a wall of fairly stiff and hard rubber. To operate the toy one simply turns it inside out and places it rim down on a flat surface. The toy will shortly start to return, at first slowly and then with increasing rapidity, to its undeformed shape. At a critical midway point the toy suddenly and completely snaps back into shape. The impact on the underlying flat surface of the deformed portion of the wall as it snaps back into shape sends the toy upwardly into the air.

In U.S. Pat. No. 5,334,079A John J. Gentile discloses a toy for launching an object when held in the hand and also launch an object when dropped on a hard surface. Such toys are commonly launched from the ground with hands which makes it risky because the distance between head and such launching object is minimized and therefore the probability of getting hurt is more. Therefore there is need of a device for launching object from the popper through a ramp actuated by foot and furthermore the object should move away from the user.

SUMMARY OF THE INVENTION

To solve the problems described above, the present invention provides following solutions.

In a preferred embodiment of the present invention there is provided a device for launching an object away from a user. The object launching device comprises a popper that can be placed on the floor for providing force to the object. The popper further comprises a center portion having a flat base and a substantially planar peripheral portion surrounding said center portion forming a convex position touching, wherein said substantially planar peripheral portion placed on the floor in a convex position, a lip portion attached to the substantially planar peripheral portion, wherein said lip portion having a front end and a back end, said back end having greater thickness than said front end and a object base formed on said central portion for allowing placement of the object, wherein the object positioned said object base.

In a further embodiment of the present invention, there is provided a device for launching an object away from a user further comprising, a ramp positioned on the popper. The ramp further comprises a curved front end positioned around said object base, an elongated body extending from said curved front end for allowing placing of a foot of the user and a plurality of legs extending from the edges of said curved front end and placed on said substantially planar peripheral portion.

In a preferred embodiment of the present invention, the user applies pressure on said substantially planar peripheral portion by pressing said plurality of legs through placement of foot on said elongated body resulting in change of convex position of said substantially planar peripheral portion returns to concave position of said substantially planar peripheral portion through the application of vertical force on said object base which further results in launching the object away from the user from said object base.

Further features and advantages of the present invention, as well as the structure and operation of various embodiments of the present invention, are described in detail below with reference to the accompanying drawings.

BRIEF DESCRIPTION OF THE DRAWINGS

For the purpose of illustration, there are shown in the drawings certain embodiments of the present invention wherein like reference numbers generally indicate identical, functionally similar, and/or structurally similar elements. It should be understood that the invention is not limited to the precise arrangements, dimensions, and instruments shown.

DETAILED DESCRIPTION OF THE INVENTION

Figure 1:
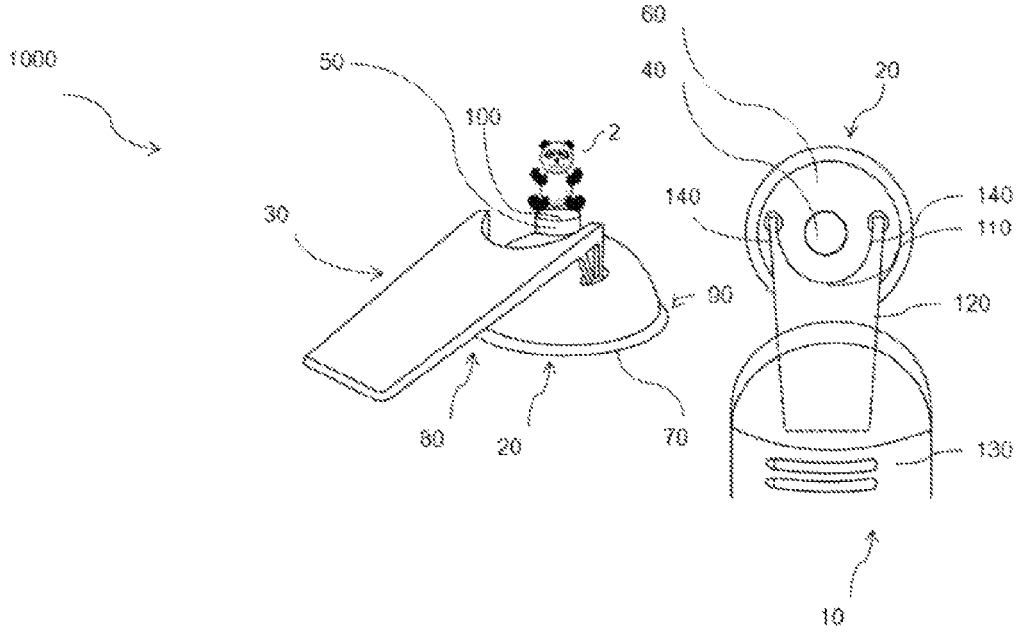
FIG. 1 depicts an object launching device according to an exemplary embodiment of the present invention.

While this technology is illustrated and described in a preferred embodiment, the device for launching object away from a user may be produced in many different configurations, forms and materials. There is depicted in the drawings, and will herein be described in detail, as a preferred embodiment of the invention, with the understanding that the present disclosure is to be considered as an exemplification of the principles of the invention and the associated functional specifications for its construction and is not intended to limit the invention to the embodiment illustrated. Those skilled in the art will envision many other possible variations within the scope of the technology described herein.

Referring to FIG. 1, there is shown an object launching device 1000 for launching an object away from a user 10 comprising a popper 20, a ramp 30. The popper 20 further comprises a center portion 40 having a flat base 50 and a substantially planar peripheral portion 60 surrounding said center portion 40 forming a convex position. The substantially planar peripheral portion 60 placed on the floor also forms in a convex position, a lip portion 70 attached to the substantially planar peripheral portion 60, wherein said lip portion 70 having a front end 80 and a back end 90, said back end 90 having greater thickness than said front end 80 and a object base 100 formed on said central portion 60 for allowing placement of the object, wherein the object positioned said object base 100. The ramp 30 further comprises a curved front end 110 positioned around said object base 100, an elongated body 120 extending from said curved front end 110 for allowing placing of a foot 130 of the user 10 and plurality of legs 140 extending from the edges of said curved front end 110 and placed on said substantially planar peripheral portion 60.

The user 10 applies pressure on said substantially planar peripheral portion 60 by pressing said plurality of legs 140 through placement of foot 130 on said elongated body 120 resulting in change of convex position of said substantially planar peripheral portion 60 returns to concave position of said substantially planar peripheral portion 60 through the application of vertical force on said object base 100 which further results in launching of the object 2 away from the user 10 from said object base 100.

Figure 2:
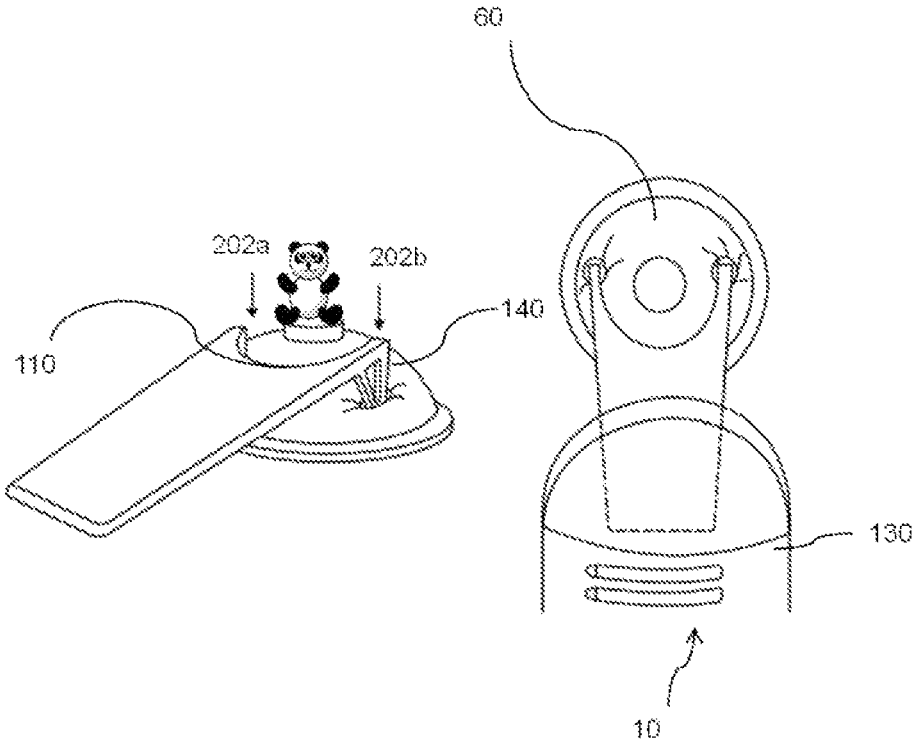
FIG. 2 depicts an object launching device according to an exemplary embodiment of the present invention showing foot area of the user placed on the ramp.
Figure 3:
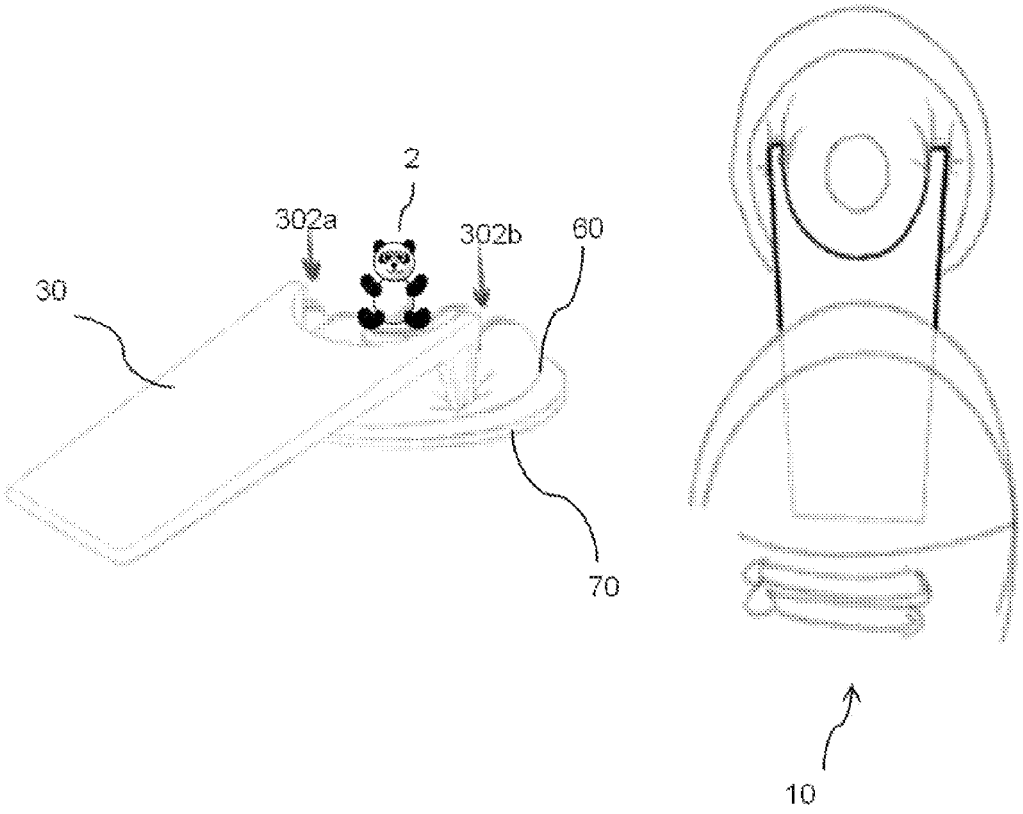
FIG. 3 depicts an object launching device according to an exemplary embodiment of the present invention showing applied pressure by the user on foot area.
Figure 4:
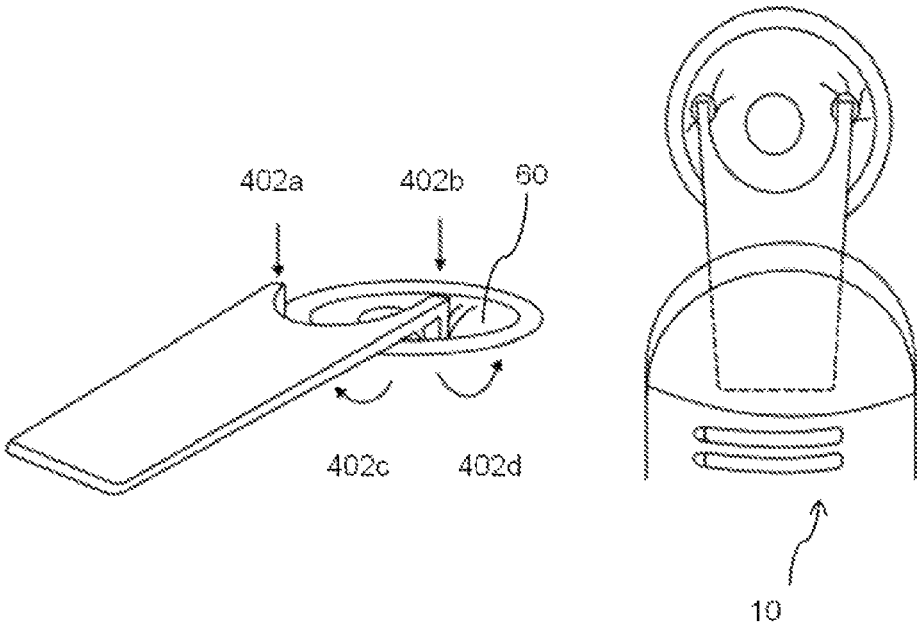
FIG. 4 depicts an object launching device according to an exemplary embodiment of the present invention showing applied pressure by the user on foot area.

FIG. 2 to FIG. 4 explains the process of change of convex position of said substantially planar peripheral portion 60 returns to concave position. FIG. 2 shows exemplary embodiment of the device, the vertical pressure is shown by arrows 202*a* and 202*b* on the legs 140 extending from the edges of the curved front end 110 are placed on the substantially planar peripheral portion 60 which puts vertical pressure on the substantially planar peripheral portion 60 due to placed foot 130 of the user 10. As an exemplary embodiment, the planer peripheral portion 60 contracts initiating the shift in position from convex to concave.

Figure 5:
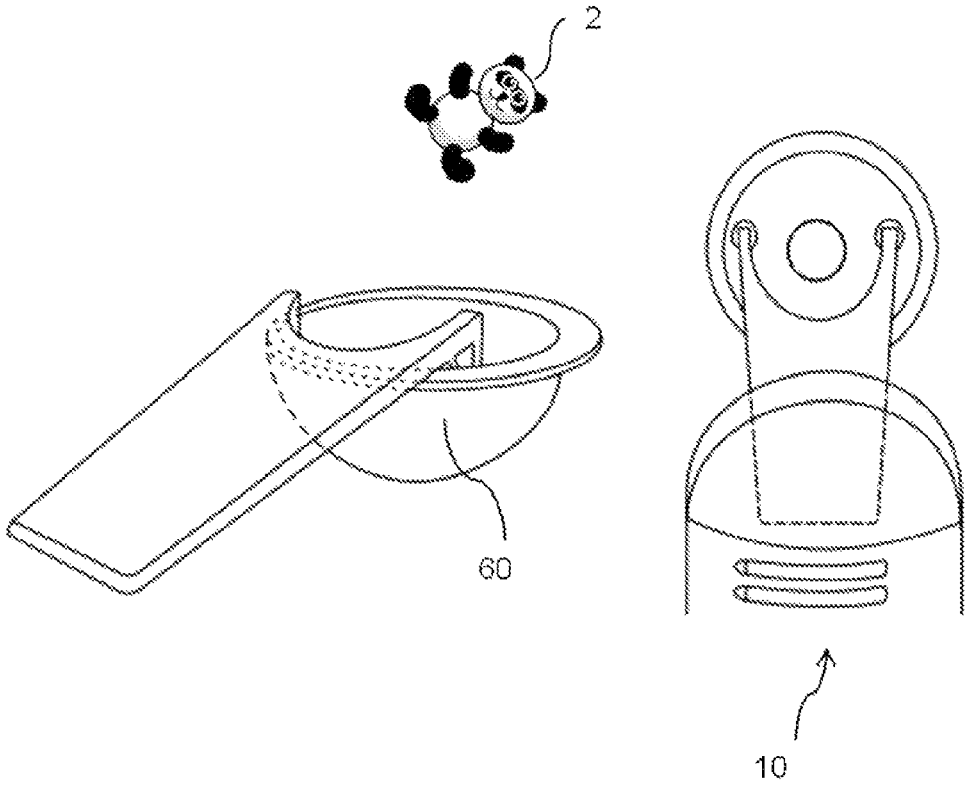
FIG. 5 depicts an object launching device according to an exemplary embodiment of the present invention showing release of applied pressure and generation of popping force.

FIG. 3 shows an exemplary embodiment of the device, the vertical pressure continuously applied by the user 10 though ramp 30. The vertical pressure is shown through arrow 302*a* and 302*b* and results in the pushing of planar peripheral portion 60 to the level of lip 70 and exposing the object 2. FIG. 4 shows an exemplary embodiment of the device, the vertical pressure continuously being applied by the user 10 results in the inside out flip of the planar peripheral portion 60 and results in the beginning of the launching of the object (not shown in the FIG. 4) in the air. The arrows 402*a*, 402*b*, 402*c* and 402*d* show the inside out flip of the planar peripheral portion 60. FIG. 5 shows exemplary embodiment of the device, the planar peripheral portion 60 completely flipped and the object 2 is airborne in a direction away from the user 10.

The present invention offers various advantages, such as allowing the user to interact from foot while playing with the popper, and thus saves the user from any injury while playing.

While multiple embodiments are disclosed, still other embodiments of the present invention will become apparent to those skilled in the art from this detailed description. The invention is capable of myriad modifications in various obvious aspects, all without departing from the spirit and scope of the present invention. Accordingly, the drawings and descriptions are to be regarded as illustrative in nature and not restrictive.

The invention claimed is:

1. A device for launching an object away from a user, said device comprising:

a popper placed on the floor for providing force for the object comprising:

a center portion having a flat base and a substantially planar peripheral portion surrounding said center portion forming a convex position touching, wherein said substantially planar peripheral portion placed on the floor in a convex position;

a lip portion attached to the substantially planar peripheral portion, wherein said lip portion having a front end and a back end, said back end having greater thickness than said front end; and an object base formed on said central portion for allowing placement of the object, wherein the object positioned said object base;

a ramp positioned on said popper comprising:

a curved front end positioned around said object base;

an elongated body extending from said curved front end for allowing placing of a foot of the user; and plurality of legs extending from the edges of said curved front end and placed on said substantially planar peripheral portion;

wherein the user applies pressure on said substantially planar peripheral portion by pressing said plurality of legs through placement of foot on said elongated body resulting in change of convex position of said substantially planar peripheral portion returns to concave position of said substantially planar peripheral portion through the application of vertical force on said object base which further results in launching the object away from the user from said object base.

* * * * *